United States Patent [19]

Nixdorff

[11] 4,020,981

[45] May 3, 1977

[54] SAFETY CLOSURE DEVICE

[75] Inventor: Frank S. Nixdorff, Baltimore, Md.

[73] Assignee: Anchor Hocking Corporation, Lancaster, Ohio

[22] Filed: Nov. 11, 1975

[21] Appl. No.: 630,940

[52] U.S. Cl. ..... 222/525

[51] Int. Cl.[2] ..... B67D 3/00

[58] Field of Search ..... 222/548, 549, 529, 554, 222/513, 564, 519, 520, 521, 525, 499, 522, 523, 402, 11, 562

[56] References Cited

UNITED STATES PATENTS

| | | | |
|---|---|---|---|
| 2,711,271 | 6/1955 | Schlicksupp | 222/521 X |
| 2,769,582 | 11/1956 | Schlicksupp | 222/521 X |
| 3,175,741 | 3/1965 | Porter | 222/521 |
| 3,240,404 | 3/1966 | Porter et al. | 222/521 |
| 3,372,833 | 3/1968 | Baranne | 222/525 X |
| 3,598,285 | 8/1971 | Stull | 222/521 X |
| 3,887,116 | 6/1975 | Ishikawa et al. | 222/520 |

*Primary Examiner*—Stanley H. Tollberg
*Assistant Examiner*—Norman L. Stack, Jr.

[57] ABSTRACT

A safety closure device for use in dispensing flowable material from containers. A base member is attachable to the container, and has an upstanding neck through which extends a dispensing bore. A closure cap is mounted on the neck and is rotatably and axially movable thereon. Movement is accomplished by means of a pair of tabs which are shielded by the base member except when rotated into alignment with a pair of recessed portions in the base member. Only when the tabs are rotatably aligned with the recessed portions can the closure cap be axially moved to uncover a dispensing opening. In a more complex embodiment of the invention, a second rotation of the closure cap is necessary after the axial movement is accomplished in order to uncover the dispensing opening.

17 Claims, 14 Drawing Figures

FIG. 1
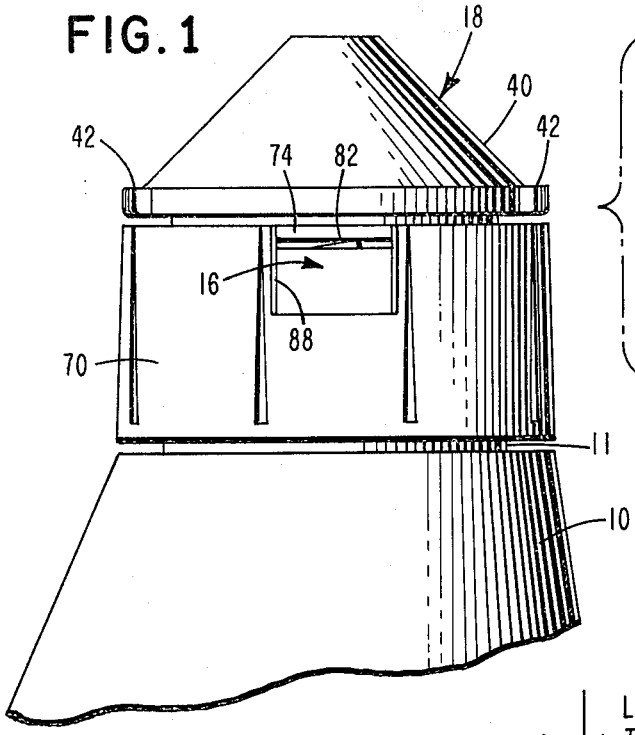
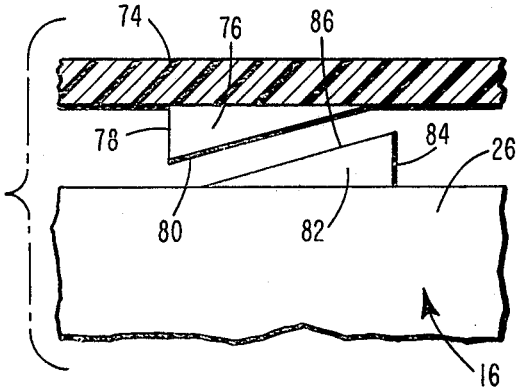
FIG. 7
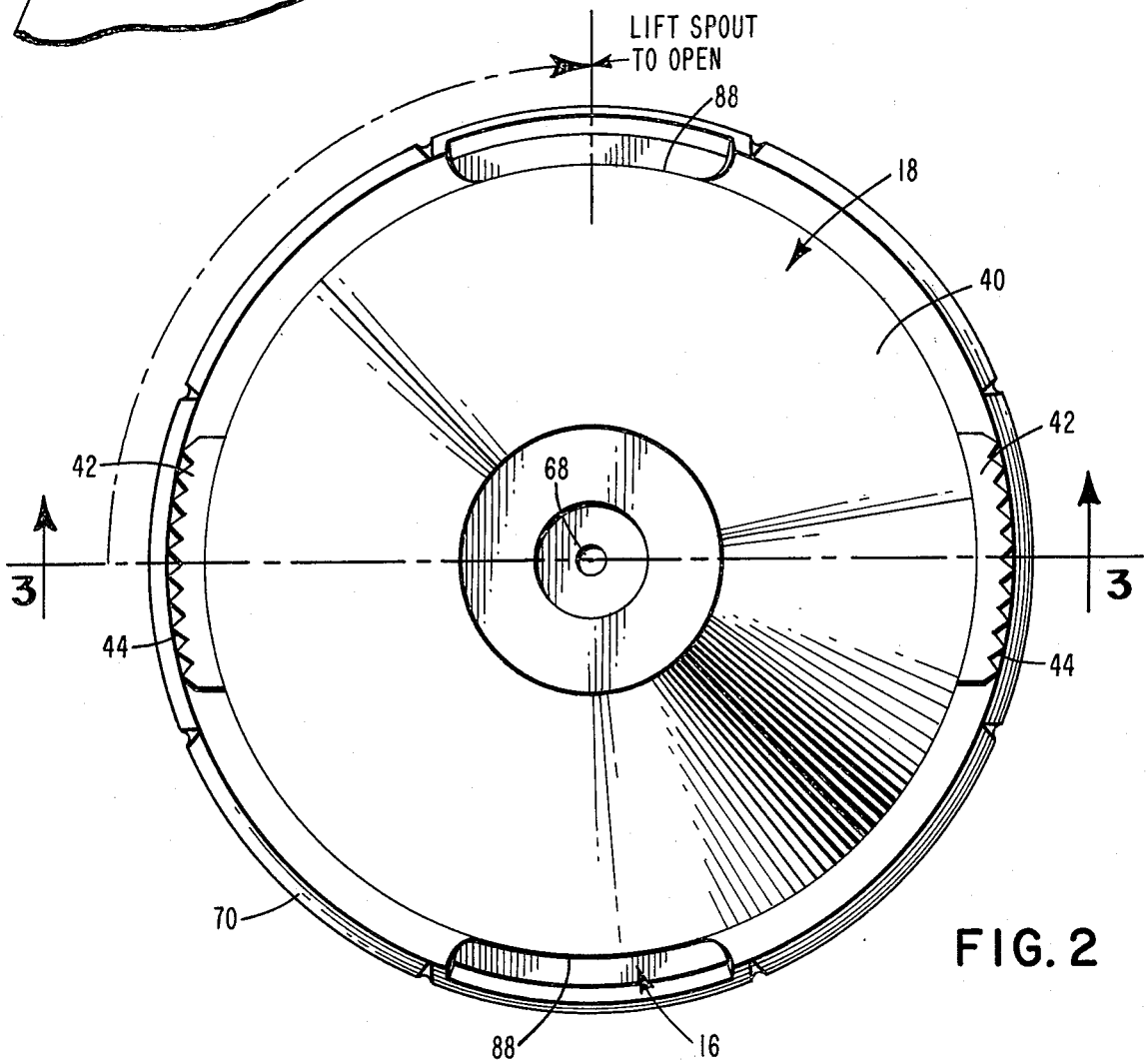
FIG. 2

SAFETY CLOSURE DEVICE

BACKGROUND OF THE INVENTION

This invention relates to a safety closure device designed primarily to deter children from dispensing flowable materials from containers. The danger of small children opening and removing dangerous materials from containers is a well known problem. While numerous safety closure devices are provided in the prior art to deter children from removing the caps from containers for pills and the like, there are few, if any, which are designed to deter the opening of containers for flowable materials such as powdered substances or liquids.

It is accordingly an object of this invention to provide a safety closure device for detering children from opening containers which contain flowable materials such as powders and liquids.

SUMMARY OF THE INVENTION

The interrelationship of elements in a safety closure device constructed in accordance with this invention requires the user first to rotate a closure cap into a particular alignment with a base member, and then to axially move the closure cap in relation to the base member to uncover a dispensing opening. In a more sophisticated embodiment of the invention, a second rotation and alignment of the closure cap is necessary after the axial movement. The invention comprises a base member which is attached to a container for liquid or other flowable materials. The base member includes a peripheral edge having at least one recessed portion and is equipped with an upstanding neck, through the center of which is a dispensing bore through which the material can flow. Installed upon the upstanding neck is a closure cap having a dispenser opening that can be placed in communication with the dispenser bore. A plurality of tab means are attached to the periphery of the closure cap, which have a radius less than or equal to that of the base member but greater than that of the innermost part of the recessed portions. A valve member is installed in the dispensing bore, and is operable to close or open the dispensing opening depending upon the position of the closure cap. In a more simple embodiment of the invention, the closure cap is movable rotatably between a safe position in which the tab means are not aligned with the recessed portion and thus the safety cap cannot be moved axially, and an operating position wherein the tab means are aligned with the recessed portions, thus allowing the user to grasp the tabs to pull the closure cap axially. The closure cap is also movable axially between a closed position wherein the valve member closes the dispensing opening, and an open position wherein the dispensing opening is clear. While in a preferred embodiment all of the elements are coaxial and of generally circular configuration, variances from this basic theme are possible within the scope of the invention.

In a more sophisticated embodiment of the invention, the dispensing opening is not coaxial with the other parts, but is offset from the axis and is connected to the dispensing bore by a channel. The dispensing opening is in this case a cut-out portion in the cap which can be rotated into alignment with the channel. There is a particular angular relationship between several of the elements. The outer end of the channel is so oriented radially with respect to the position of the tab means and the dispenser opening, that when the tab means are in alignment with the recessed portions, the outer end is not in alignment with the dispensing opening. Axial movement of the closure cap opens the dispensing bore, but does not clear the dispensing channel, which is not aligned with the dispensing opening. A second rotation of the closure cap is then required to align the dispensing opening with the outer end of the channel. When the dispensing opening and the channel are aligned, the tab means and the recessed portions are not in alignment. Therefore, when the closure cap is moved axially to the closed position, it is automatically in the safe position.

BRIEF DESCRIPTION OF THE DRAWINGS

FIG. 1 is a side view of a first embodiment of this invention, showing the closure cap in the closed position.

FIG. 2 is a top view of the device of FIG. 1, showing the closure cap in the safe position.

FIG. 7 is an enlarged view of a portion of the one-way threading device utilized for attaching the safety closure device to the container.

DESCRIPTION OF THE PREFERRED EMBODIMENTS

Presented hereafter is the description of two child proof safety closure devices which embody one or more of the concepts of this invention. The first embodiment of the invention is shown in FIGS. 1–9, and the second in FIGS. 10–14. While there are many similarities between the two, the first embodiment of the invention is more simple and therefore less difficult to defeat than the second embodiment, which is much more complicated in structure and operation.

DESCRIPTION OF THE FIRST EMBODIMENT

Figure 3:
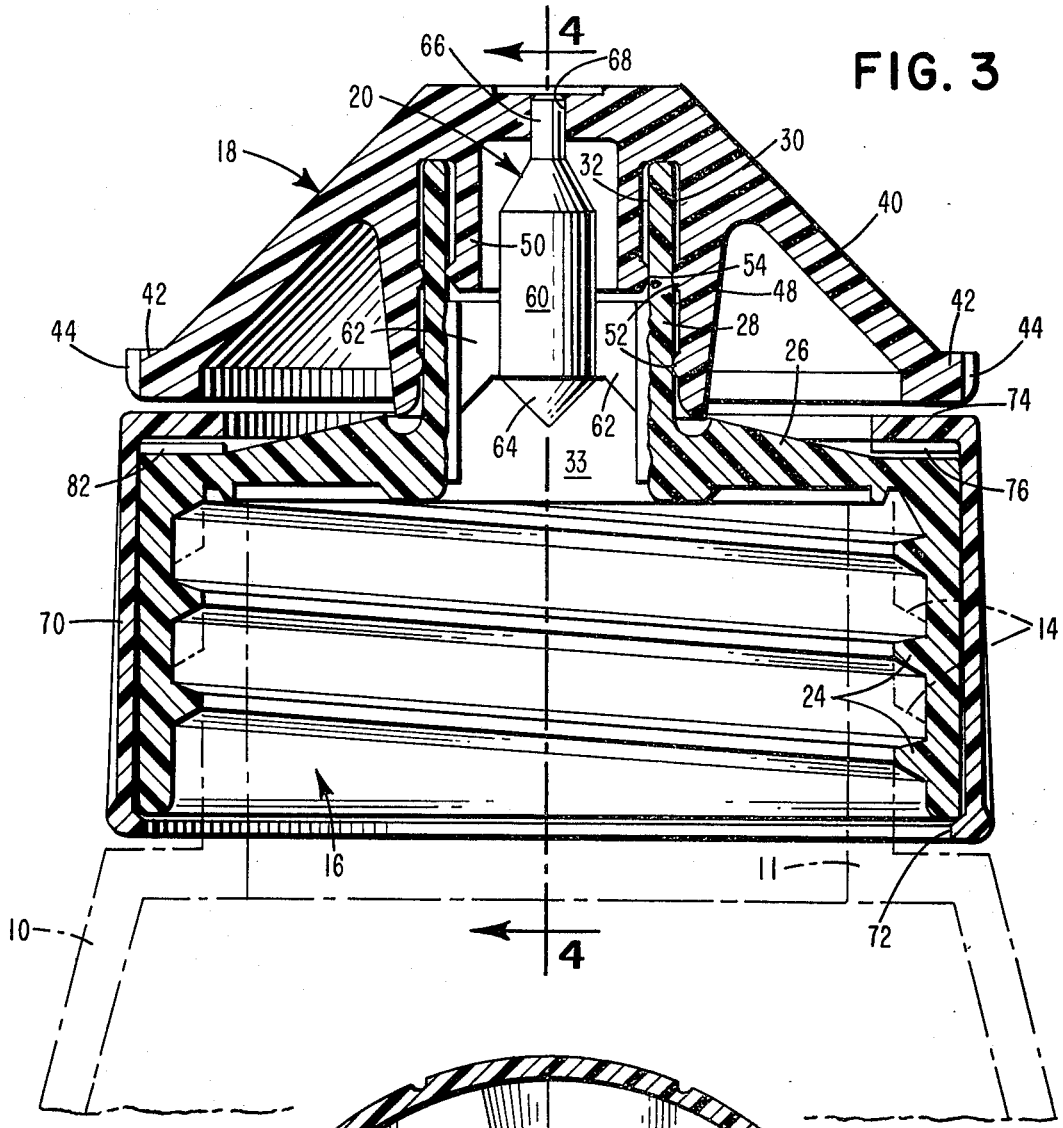
FIG. 3 is an elevational view of the device of FIG. 1 partially in section, taken through line 3—3 of FIG. 1.
Figure 4:
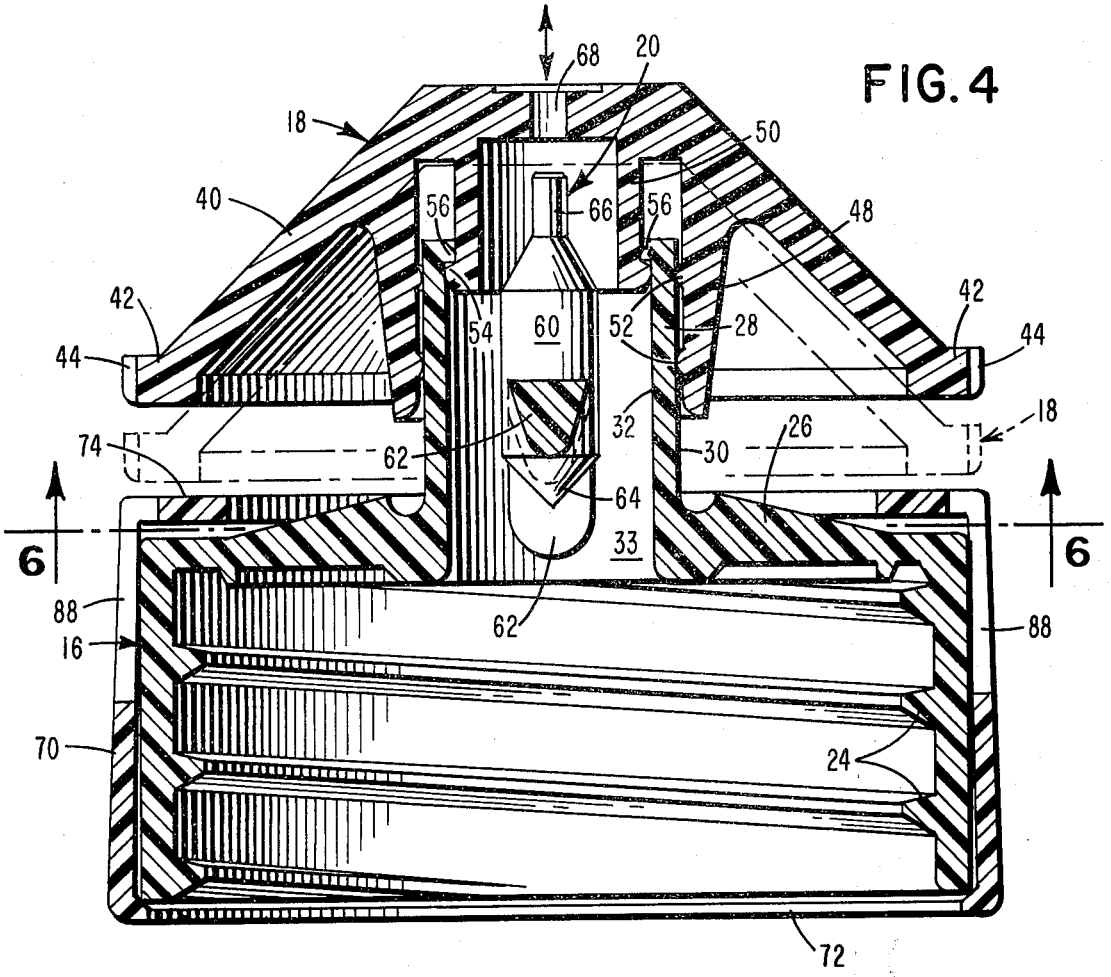
FIG. 4 is an elevational view, partially in section, taken through line 4—4 of FIG. 3, showing the closure cap in its open position in solid lines and in its closed position in broken lines.
Figure 5:
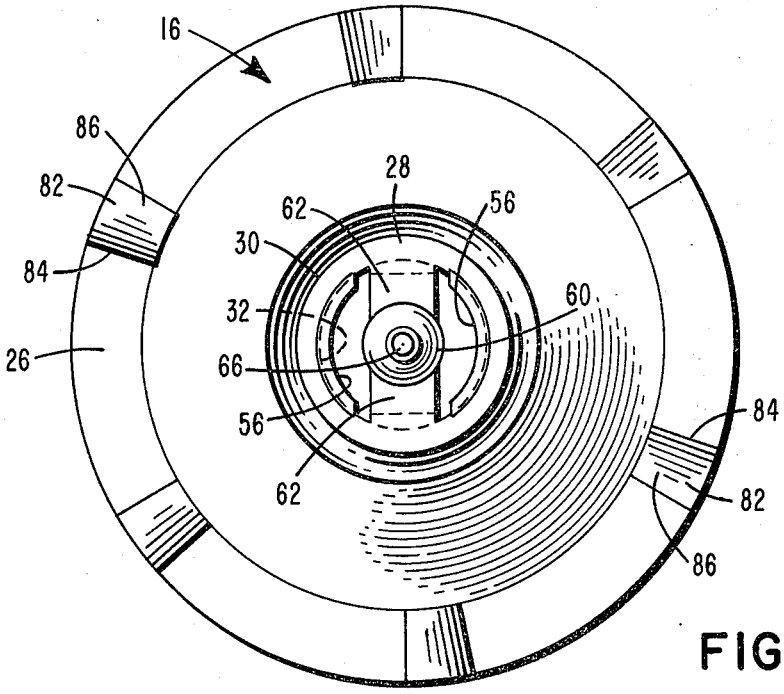
FIG. 5 is a top view of the base member of the safety closure device, with the safety skirt removed.

Looking now to FIGS. 1 through 9, the first embodiment of the invention will be described. The inventive safety closure device is designed for use on a container 10, upon the top of which is formed a container neck portion 11, which has a plurality of threads 14 (FIGS. 3, 4 and 9). As best shown in FIG. 3, the closure member of this embodiment of the invention comprises a base member 16, a closure cap 18, and a valve element 20.

Base member 16 has internal threads 24 which interact with the container neck threads 14 in order to attach the device to the container. Base member 16 comprises an integral top wall 26, upon which is situated an integral neck 28, which has an outer surface 30 and an inner surface 32, which defines a dispensing bore 33.

Closure cap 18 has an outer frustoconical wall 40 which is provided along its lowermost outer periphery with a pair of outwardly extending tabs 42 which terminate in roughened portions 44 in order to facilitate engagement by the user's fingers. The outer envelope of safety cap 18 is designed to be difficult to grasp. The radius from the center axis of the closure cap to the outer edge of tabs 42 is approximately equal to the radius of base member 16. The remainder of the lowermost outer periphery of wall 40 is of lesser radius, so it cannot be grasped. Closure cap 18 is mounted upon the upstanding neck 28, by the interaction with neck 28 of an annular outer flange 48 and an annular inner flange 50. Extending inwardly from the inner surface of outer flange 48 are a pair of annular shoulders 52, and extending outwardly from the outer surface of inner flange 50 is an annular shoulder 54. Shoulders 48, 52 and 54 frictionally bear against, respectively, the outer surface 30 and inner surface 32 of neck 28, in order to inhibit the axial and rotational movement of closure cap 18. Positioned on the upper portion of inside surface 32 are a plurality of inwardly oriented stops 56 (FIG. 4) which are engaged by shoulders 54 to limit the axial movement of closure cap 18.

Valve element 20 comprises a valve member 60 which is centrally positioned within dispensing bore 33. It is supported therein by a plurality of inwardly extending struts 62. At its lower portion, valve member 60 is provided with a cone-shaped base 64 and at its upper end with a plug portion 66, which fits into a dispensing opening 68 in closure cap 18.

Optionally, base member 16 can be provided with an annular skirt 70 to prevent the safety closure device from being removed from the container. Skirt 70 comprises a lower inwardly extending lip 72 and an upper inwardly extending flange 74. Skirt 70 is rotatable relative to base member 16. Flange 74 is provided on its underside with a plurality of teeth 76, each of which has a perpendicular forward edge 78 and a sloping rear surface 80 (see FIG. 7). The upper wall 26 of the base member 16 is provided with a plurality of oppositely oriented teeth 82, each of which also has a perpendicular edge 84 and an inclined surface 86. As can be seen in FIG. 7, rotation of the skirt in the clockwise direction, with downward pressure, will cause engagement of the edges 78 and 84, thus rotating base member 16 and tightening it upon the bottle neck 11. Rotation of the skirt in the opposite direction will simply engage the inclined sides 80 and 86, so that it is very difficult to unscrew the base member 16. This arrangement serves a dual purpose. It allows the safety closure device to be installed upon a container by existing screw cap type installation machinery, and it also prohibits, to a great extent, removal of the safety closure by the user.

Figure 6:
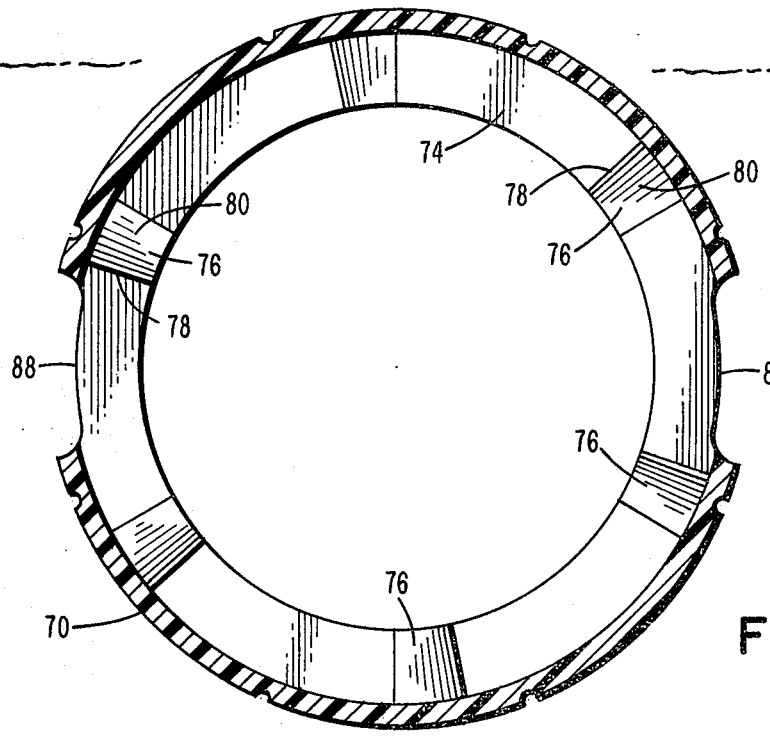
FIG. 6 is a bottom view of one portion of the one-way threading mechanism taken through line 6—6 of FIG. 4.

As best shown in FIG. 6, the upper peripheral edge of skirt 70 is provided with a pair of recessed portions 88, which are oppositely oriented. Recessed portions 88 are of sufficient width to expose a major portion of tabs 44. The remainder of the peripheral skirt 70 serves to shield tabs 42, preventing them from being grasped to pull closure cap 18 upwardly to its open position.

Figure 8:
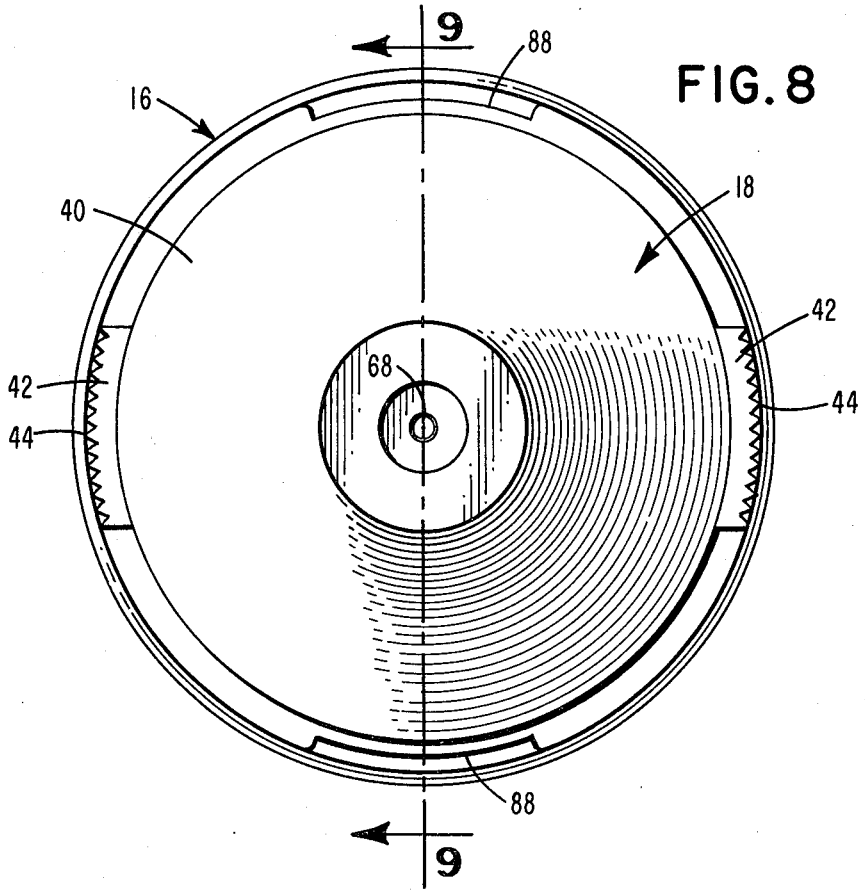
FIG. 8 is a top view of an alternative construction of the device shown in FIG. 1.
Figure 9:
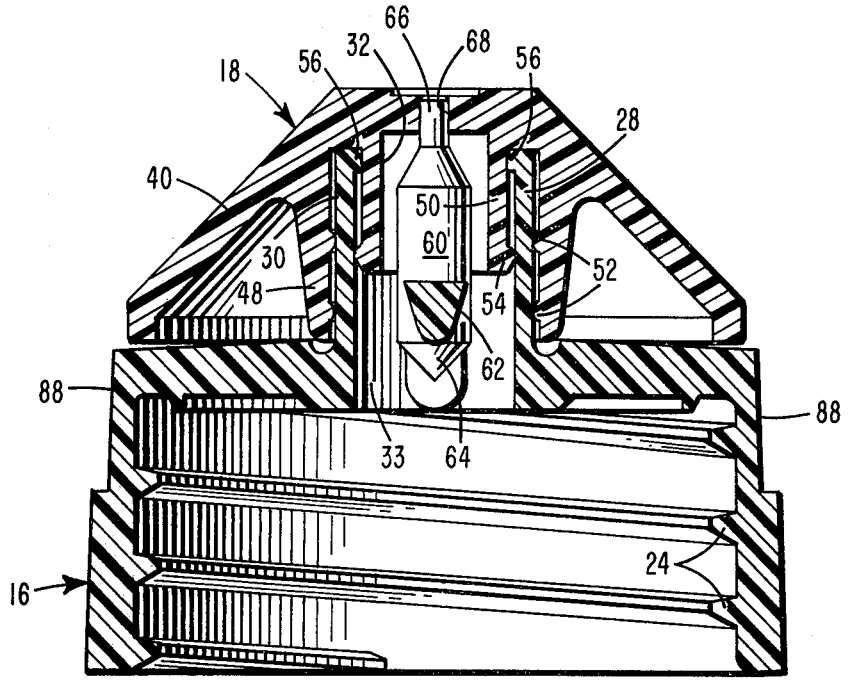
FIG. 9 is an elevational view, partially in section, of the device of FIG. 8 taken through line 9—9 of FIG. 8.

The closure device shown in FIGS. 8 and 9 is the same as that described above, except that the safety skirt 70 is not present. In such case, recessed portions 88 are provided in the upper peripheral edge of the base member itself.

OPERATION OF THE FIRST EMBODIMENT

The embodiment described above is installed by screwing the container cap portion 16 upon the neck 11 of the container, by the suitable rotation of the skirt 70 or, in the embodiment where there is no skirt, by direct action with the outer surface of base member 16. While the base member has been shown here in a configuration which screws upon the top of the container, it should be understood that the invention is not so limited, and that other well known means for attaching such to the upper portion of containers could be used, or as another alternative, the base member can be made integral with the upper portion of the container.

Initially, the closure cap 18 is in its closed position insofar as axial movement is concerned, with plug 66 extending into and closing the dispensing opening 68, as shown in FIGS. 1 and 3. To be child-proof, it must also initially be in its safe position insofar as rotational alignment is concerned, that is, with tabs 42 out of alignment with recessed portions 88. This is shown in FIG. 2. In such a position, it is very difficult, if not impossible, to move the closure cap 18 axially to its open position, because closure cap 18 cannot easily be grasped. In order to dispense material from the container, closure cap 18 must first be rotated to its operating position, wherein tabs 42 are in alignment with recessed portions 88. In such a position, tabs 42 can be grasped with the fingers to move closure cap 18 upwardly to the open position shown in FIG. 4, where plunger 66 is withdrawn from dispensing opening 68. To close the container, closure cap 18 is simply pushed downwardly to its closed position and is rotated to its safe position.

DESCRIPTION OF THE SECOND EMBODIMENT

Figure 12:
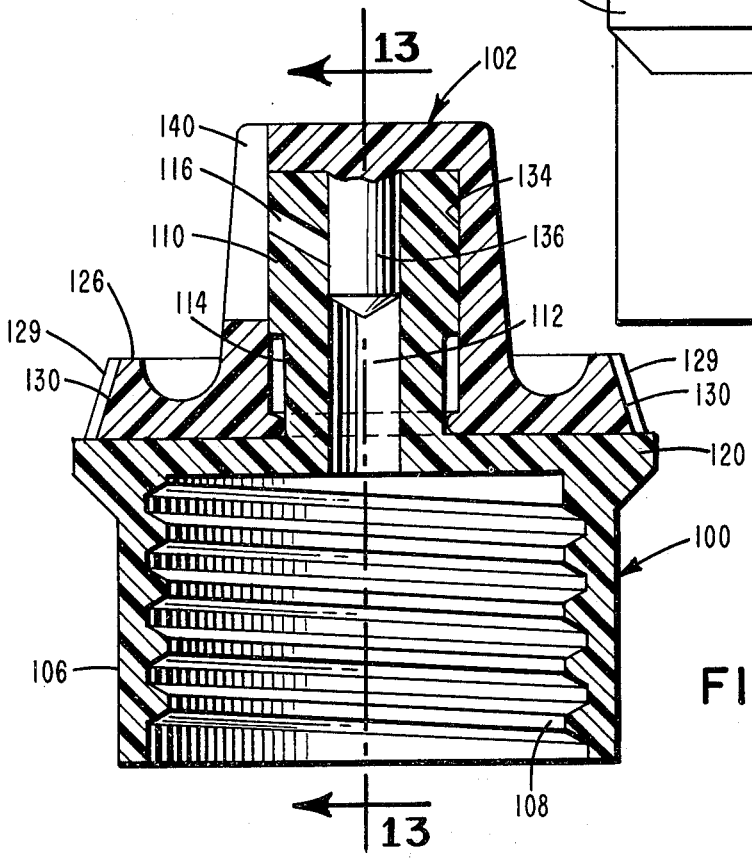
FIG. 12 is a side view, partially in section, taken through line 12–12 of FIG. 10, showing the closure cap in the closed position.
Figure 13:
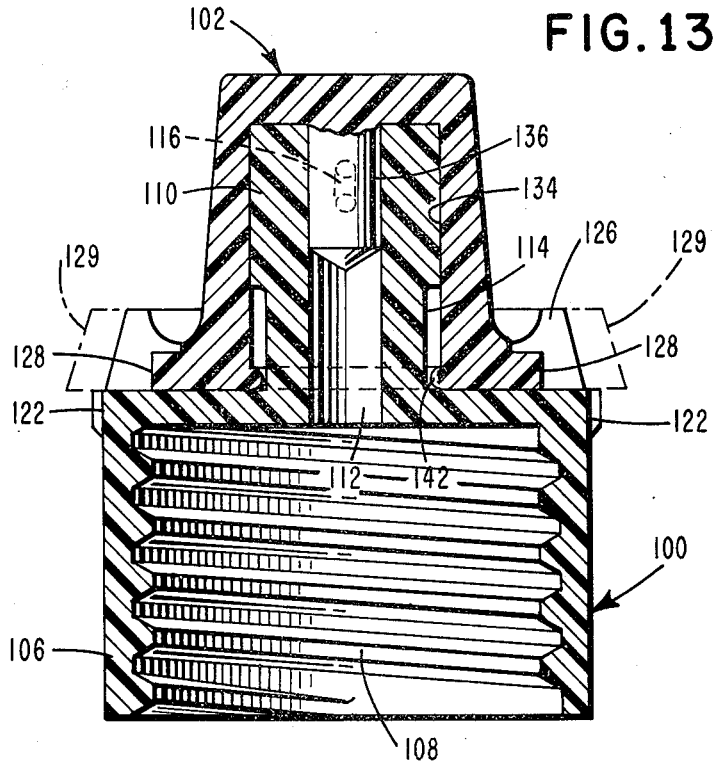
FIG. 13 is an elevational view partially in section, taken through line 13—13 of FIG. 12, showing the closure cap in the operating position.
Figure 14:
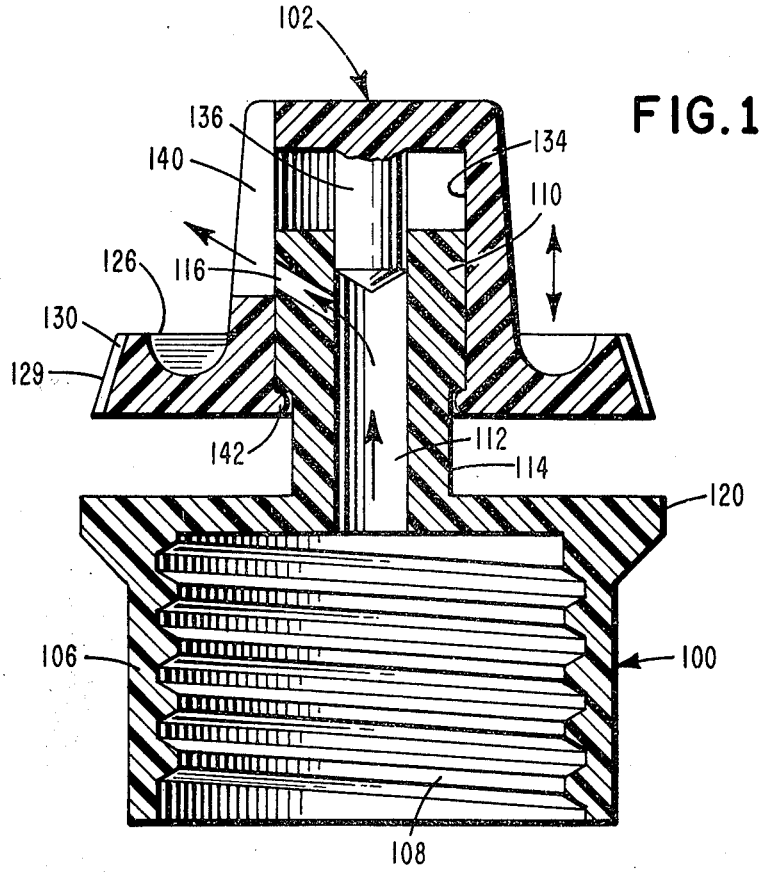
FIG. 14 is a side view, partially in section, of the device of FIG. 13, rotated ninety degrees, showing the closure cap in the open position.

The second embodiment of the invention is shown in FIGS. 10–14. It also has the basic features of the first embodiment above described, but is more complex and provides a greater degree of safety. As best shown in FIG. 12, the second closure device comprises a base member 100 and a closure cap 102. Base member 100 has an annular wall 106 and a threaded portion 108, which interacts with the threaded portion of the neck of a container, not shown. Extending upwardly from the base member 100 is a neck 110, which has a dispensing bore 112, and an annular indented portion 114. Dispensing bore 112 is provided with a sidewardly oriented dispensing channel 116. Extending around the upper peripheral edge of base member 100 is an annular shoulder 120 which is provided with a pair of recessed portions 122, best shown in FIG. 10.

Closure cap 102 has a flanged portion 126 around the lower edge thereof, which is provided with a pair of recessed portions 128 of the same general size as recessed portions 122. The remainder of the peripheral edge of shoulder 126 is considered to be tabs 129, which are equipped with grooves 130 to facilitate grasping by the user for rotation. Closure cap 102 has an internal cavity 134 which is closed at the top, and a valve member in the form of a plunger 136 which extends downwardly into dispensing bore 112 to such an extent that when in the closed position as shown in FIG. 12, it blocks dispensing channel 116. Closure cap 102 also has a cut-out portion or dispenser opening 140 which can be aligned with dispenser channel 116 in order to allow material to flow from the container.

The angular relationship between the various elements of this embodiment of the invention is very important. Advantageously, dispensing channel 116 is spaced radially ninety degrees from recessed portions 122. Dispensing opening 140 is aligned radially with the mid-points of tabs 129, so that when tabs 129 are aligned with recessed portions 122, dispensing channel 116 is not aligned with dispensing opening 140. The significance of this will be seen from the following explanation of operation. Axial movement is limited by the interaction of an annular shoulder 142 with the upper limits of recess 114.

The skirt and one-way rotation feature for installing the safety closure device upon a container can also be used with this embodiment with suitable modifications, although not shown.

OPERATION OF THE SECOND EMBODIMENT

Figure 10:
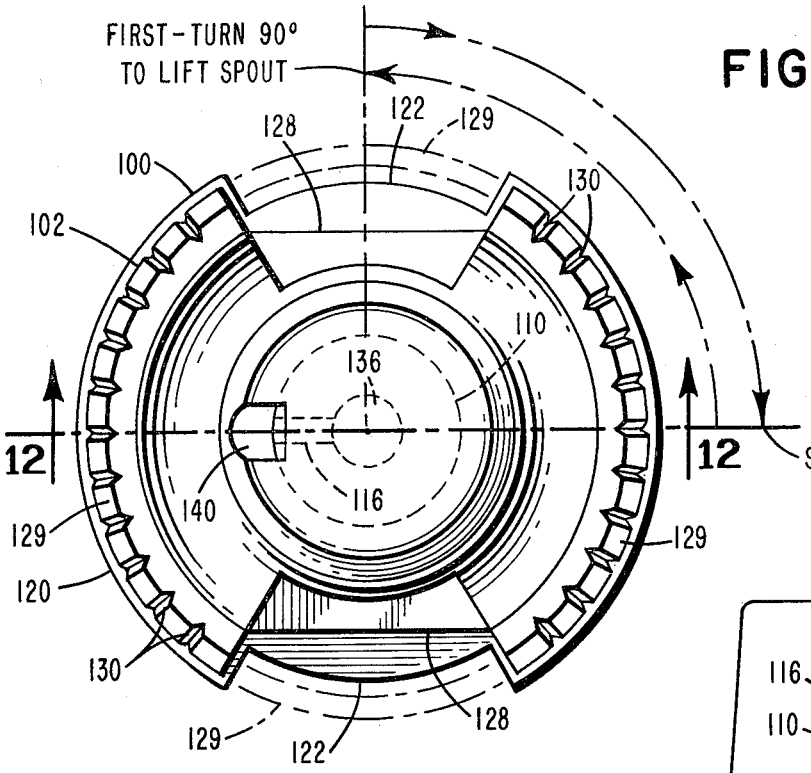
FIG. 10 is a top view of a second embodiment of the invention, showing the closure cap in the safe position.
Figure 11:
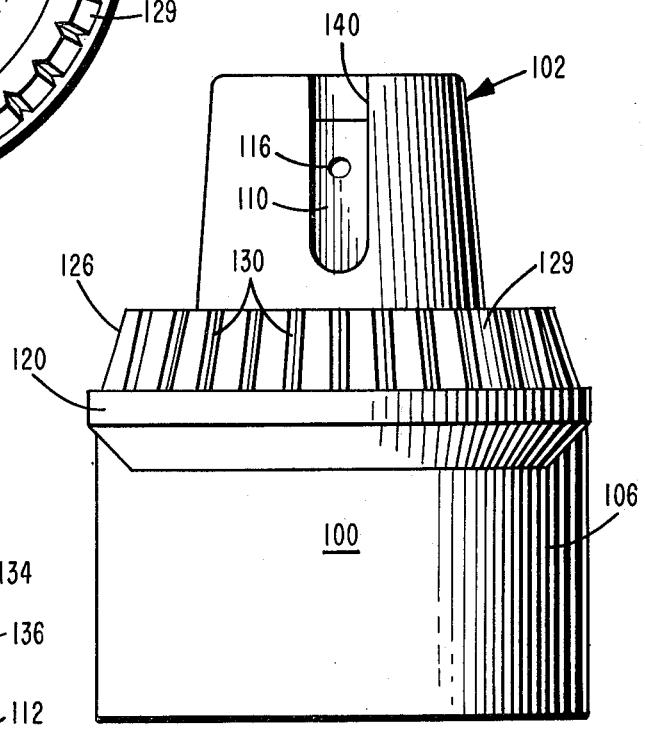
FIG. 11 is a side view of the device shown in FIG. 10.

The novel features of this invention can best be appreciated by an explanation of its operation. In its safe, or child-proof condition, closure cap 102 is oriented as shown in FIGS. 10 and 12. That is, it is in its lowermost or closed position, wherein plug 136 blocks the inner end of dispensing channel 116. It is also radially oriented so that recessed portions 122 and 128 are aligned with one another. In this, the safe position of the closure cap, the user cannot operate tabs 129 axially. To dispense material, cap 102 must first be rotated ninety degrees, so that tabs 129 are placed in alignment with recessed portions 122. Then, the user can grasp tabs 129 with his fingers and pull upwardly to move closure cap 102 axially to its upper position. However, at this point, although plug 136 has been withdrawn to clear the inner end of channel dispenser 116, its outer end is still blocked because it is not aligned with dispensing opening 140, so material cannot yet be dispensed. Closure cap 102 must again be rotated 90°, to align dispensing bore 116 and dispensing opening 140, while closure cap 102 remains in its upper position. To close the safety closure device, closure cap 102 need only be moved axially downwardly. Then, not only is plug 136 once again in position blocking dispensing channel 116, but tabs 129 are automatically placed out of alignment with recessed portions 122, without further action by the user.

The invention described and claimed herein is primarily for use with containers for dispensing flowable materials, such as liquids or powders. It could, however, have broader uses. While shapes, cross-sectional configurations, and relationship of and between the various elements may be optimized in the specific embodiments described herein, such are not to be considered as limiting factors. Once having been exposed to the teachings of the invention herein set forth, those skilled in the art may perceive modifications and variations to the embodiments described. However, the invention is to be limited only by the scope of the appended claims.

I claim:

1. A safety closure device for containers comprising:

a base member disposed about a central axis and comprising an annular base surface facing in a first direction having a peripheral edge spaced a first distance from said central axis, at least one radially inwardly recessed portion in said peripheral edge spaced from said central axis a second distance less than said first distance, and a neck upstanding from said base surface in said first direction and having a dispensing bore terminating at its outer end in a bore opening, a valve member positioned in said dispensing bore for selectively controlling dispensing from said safety closure device, a closure cap mounted on said neck and being rotatably and axially movable with respect thereto, said closure cap having a substantially smooth outer surface that is difficult to grasp for axial movement of said closure cap, said closure cap comprising a dispensing opening registerable with said bore opening and radially extending manually operable tab means selectively radially alignable with said recessed portion and having a tab surface in opposed relationship to said base surface, said tab means extending radially outwardly a third distance greater than said second distance and substantially not greater than said first distance, said closure cap being movable rotatably about said central axis with respect to said base member between a safe position wherein said tab means is not aligned with said recessed portion and an operating position wherein at least a portion of said tab means is aligned with said recessed portion, said closure cap also being axially movable with respect to said base member by manually engaging said tab means between a closed position wherein said tab surface is adjacent to said base surface and said valve member blocks flow through said dispensing opening and an open position wherein said tab surface is spaced from said base surface and said valve member permits flow through said dispensing opening whereby said tab means is masked by said base surface and said peripheral edge when in said closed position not aligned with said recess and thereby cannot easily be manually engaged to move said closure cap axially in said first direction, but is unmasked when in at least partial alignment with said recessed portion to allow said closure cap to be moved from said closed position to said open position.

2. The safety closure device of claim 1 wherein said neck comprises a cylindrical neck wall having an inner surface and an outer surface, and said closure cap has an annular wall adjacent to one of said surfaces of said neck wall and having portions in frictional engagement therewith.

3. The safety closure device of claim 2 wherein said annular wall is adjacent to said inner surface of neck wall, and further comprising a second annular closure cap wall adjacent to said outer surface of said neck wall and having portions in frictional engagement therewith.

4. The safety closure device of claim 2 further comprising axial movement stop means mounted on said neck wall and engageable with said portions in frictional engagement with said neck wall to define the limits of said open position.

5. The safety closure device of claim 1 wherein said base member, said neck and said closure cap are of substantially circular configuration and are coaxial with said central axis.

6. The safety closure device of claim 5 wherein said dispensing bore, said dispensing opening, and said valve member are coaxial with said central axis, and wherein said valve member comprises a plug movable into said dispensing opening in sealing relationship therewith when said closure cap is in said closed position.

7. The safety closure device of claim 1 wherein said base member comprises a threaded portion screwable onto a container, an annular outside surface, annular skirt means disposed around said outside surface and being rotatably movable with respect thereto, and one-way driving means interposed between said skirt means and said outside surface for allowing said safety closure device to be rotated by said skirt means only in the direction to screw said threaded portion onto said container.

8. The safety closure device of claim 7 wherein said recessed portion is in said skirt means.

9. The safety closure device of claim 1 wherein said dispensing opening is radially spaced from said central axis, and further wherein said dispensing bore has at least a portion radially disposed in the side wall of said neck and said bore opening is radially spaced from said central axis and registerable with said dispensing opening in said closure cap, and wherein said valve member closes said dispensing bore when said closure cap is in said closed position and opens said dispensing bore when said closure cap is in said open position, said dispensing opening being so oriented circumferentially with respect to said tab means as to be alignable with said bore opening only when said tab means is not in alignment with said recessed portion.

10. The safety closure device of claim 9 further comprising a pair of oppositely disposed recessed portions and a pair of oppositely disposed tab means, said recessed portions being radially spaced ninety degrees from said dispensing channel.

11. The safety closure device of claim 9 wherein said dispensing bore comprises a first portion coaxial with said central axis and a second portion radially disposed with regard to said central axis, said bore opening being at the outer end of said second portion and said second portion having an inner end in communication with said first portion, and wherein said valve means comprises a plug carried by said closure cap and extending into said first portion of said dispensing bore to close said inner end of said second portion when said closure cap is in said closed position and to open said inner end when said closure cap is in said closed position.

12. The safety closure device of claim 9 wherein said valve member comprises a plug carried by said closure cap and extending into said dispensing bore.

13. The safety closure device of claim 12 wherein said neck comprises a cylindrical neck wall having an inner surface and an outer surface, and at least portions of said plug are in frictional engagement with said inner wall.

14. The safety closure device of claim 13 further comprising first shoulder means positioned on said outer wall and second shoulder means carried by said closure cap and engageable with said first shoulder means to define the limit of said open position.

15. The safety closure device of claim 1 comprising a pair of oppositely positioned recessed portions on said base member and a pair of oppositely positioned tab means on said closure cap.

16. A safety closure device for containers comprising:

a substantially cylindrical base member disposed about a central axis closed at one end and having an annular base surface at said one end facing in a first direction and terminating in a peripheral edge radially spaced a first distance from said central axis, a pair of oppositely oriented radially inwardly recesses in said peripheral edge, each of said recesses having an inner edge radially spaced from said central axis a second distance less than said first distance, and a generally cylindrical neck upstanding from said base surface in said first direction and coaxial with said central axis and having a dispensing bore coaxial with said central axis terminating at its outer end in a bore opening, said neck also comprising an inner surface and an outer surface, a valve member positioned in said dispensing bore for selectively controlling dispensing from said safety closure device, a closure cap mounted on said neck and being rotatably and axially movable with respect thereto, said closure cap having a substantially frustoconical outer surface with its minor end directed in said first direction, a dispensing opening in said closure cap at the minor end thereof in alignment with said valve member and said bore, a pair of oppositely oriented radially extending manually operable tabs positioned at the major end of said closure cap, said tabs being selectively radially alignable with said recesses and each having a tab surface in opposed relationship to said base suface, said tabs extending radially outwardly a third distance greater than said second distance and substantially not greater than said first distance, said closure cap further comprising an inner annular wall in frictional engagement with one of said surfaces of said neck, said closure cap being movable rotatably about said central axis with respect to said base member by manually engaging said tabs between a safe position wherein said tabs are not aligned with said recesses and an operating position wherein at least a portion of each of said tabs are aligned with said recesses, said closure cap also being axially movable with respect to said base member when in said operating position by manually engaging said tabs between a closed position wherein said tab surfaces are adjacent to said base surface and said valve member blocks flow through said dispensing opening and an open position wherein said tab surfaces are spaced from said base surface and said valve member permits flow through said dispensing opening whereby said tabs are masked by said base surface and said peripheral edge when in said closed position not aligned with said recess and thereby cannot easily be manually engaged to move said closure cap axially in said first direction, but are unmasked when in at least partial alignment with said recesses to allow said closure cap to be moved from said closed position to said open position, and interengaging stop means on said neck and on said inner wall of said closure cap for defining said open position of said closure cap.

17. A safety closure device for containers comprising:

a substantially cylindrical base member disposed about a central axis closed at one end and having an annular base surface at said one end facing in a first direction and terminating in a peripheral edge radially spaced a first distance from said central axis, a pair of oppositely oriented radially inwardly recesses in said peripheral edge, each of said recesses having an inner edge radially spaced from said central axis a second distance less than said first distance, a generally cylindrical neck upstanding from said base surface in said first direction and coaxial with said central axis, said neck having a dispensing bore coaxial with said central axis and a dispensing channel communicating with said bore and at an angle thereto, said dispensing channel terminating at its outer end in a bore opening spaced radially from said central axis, said neck also comprising an inner surface and an outer surface, a valve member positioned in said dispensing bore for selectively controlling dispensing from said safety closure device, said valve member comprising a plug movable relative to said bore to selectively block said channel and means for mounting said plug for relative movement with respect to said channel, a closure cap mounted on said neck and being rotatably and axially movable with respect thereto, said closure cap having a substantially smooth outer surface with one end directed in said first direction, a dispensing opening in said closure cap radially spaced from said central axis and registerable with said bore opening, a pair of oppositely oriented radially extending manually operable tabs positioned at the other end of said closure cap, said tabs being selectively radially alignable with said recesses and each having a tab surface in opposed relationship to said base surface, said tabs extending radially outwardly a third distance greater than said second distance and substantially not greater than said first distance, said closure cap further having an inner annular wall in frictional engagement with one of the surfaces of said neck, said closure cap being movable rotatably about said central axis with respect to said base member by manually engaging said tab means between a safe position wherein said tabs are not aligned with said recesses and an operating position wherein at least a portion of said tabs are aligned with said recesses, said closure cap also being axially movable with respect to said base member by manually engaging said tabs between a closed position wherein said tab surfaces are adjacent to said base surface and said plug is in such position with respect to said channel as to block flow through said channel and an intermediate position spaced axially from said closed position wherein said tab surface is spaced axially from said base surface and said plug is in such position with respect to said channel as to permit flow through said channel, said tabs being so oriented circumferentially with respect to said dispensing opening that said dispensing opening is radially alignable with said bore opening only when said closure cap is rotatably oriented in said safe position, said dispensing opening being so located axially on said closure cap as to be alignable with said bore opening only when said closure cap is axially oriented in said intermediate position, said tabs being masked by said base surface and said peripheral edge when said closure cap is axially in said closed position and rotatably in said safe position whereby said tabs are not easily manually engageable to move said closure cap axially in said first direction, said tabs being unmasked when said closure cap is rotatably in said operating position to allow said closure cap then to be movable from said closed position to said intermediate position, and interengaging stop means on said neck and on said closure cap for axially defining said intermediate position of said closure cap, whereby to dispense said closure cap must first be rotated to said operating position, then moved axially to said intermediate position, and finally rotated while in said intermediate position to align said dispensing opening with said bore opening.

* * * * *